US011728586B2

(12) United States Patent
Tsai et al.

(10) Patent No.: US 11,728,586 B2
(45) Date of Patent: Aug. 15, 2023

(54) WIRE-CLAMPING CONNECTOR ASSEMBLY

(71) Applicant: CviLux Corporation, New Taipei (TW)

(72) Inventors: Keng-Sheng Tsai, Taipei (TW); Chin-Chiang Chen, New Taipei (TW)

(73) Assignee: CVILUX CORPORATION, New Taipei (TW)

( * ) Notice: Subject to any disclaimer, the term of this patent is extended or adjusted under 35 U.S.C. 154(b) by 82 days.

(21) Appl. No.: 17/577,186

(22) Filed: Jan. 17, 2022

(65) Prior Publication Data

US 2022/0416458 A1 Dec. 29, 2022

(30) Foreign Application Priority Data

Jun. 25, 2021 (TW) ..... 110207347

(51) Int. Cl.

| | |
|---|---|
| ***H01R 12/79*** | (2011.01) |
| ***H01R 13/424*** | (2006.01) |
| ***H01R 13/506*** | (2006.01) |
| ***H01R 12/70*** | (2011.01) |

(52) U.S. Cl.

CPC ..... *H01R 12/79* (2013.01); *H01R 12/707* (2013.01); *H01R 13/424* (2013.01); *H01R 13/506* (2013.01)

(58) Field of Classification Search

CPC .... H01R 12/721; H01R 12/725; H01R 12/77; H01R 12/78; H01R 12/79; H01R 12/707; H01R 12/59; H01R 12/592; H01R 12/61; H01R 13/424; H01R 13/506

See application file for complete search history.

(56) References Cited

U.S. PATENT DOCUMENTS

| | | | | |
|---|---|---|---|---|
| 8,052,464 | B2 * | 11/2011 | Maruishi | H01R 12/79 439/496 |
| 9,812,801 | B2 * | 11/2017 | Okura | H01B 7/08 |
| 2006/0286859 | A1 * | 12/2006 | Shimizu | H01R 12/771 439/496 |
| 2013/0337688 | A1 * | 12/2013 | Zong | H01R 43/20 29/830 |

* cited by examiner

*Primary Examiner* — Oscar C Jimenez

(74) *Attorney, Agent, or Firm* — Li & Cai Intellectual Property (USA) Office

(57) ABSTRACT

A wire-clamping connector assembly includes a wire-clamping connector and a mating connector that are mated with each other. The wire-clamping connector includes a casing and a conductive cable. The casing includes a first wire-fixing portion, a second wire-fixing portion, and a third wire-fixing portion that is located therebetween. A first gap is formed between the first wire-fixing portion and the third wire-fixing portion, and a second gap is formed between the second wire-fixing portion and the third wire-fixing portion. The conductive cable includes a conductive cable body and insulating bodies that cover the conductive cable body. The conductive cable passes through the first gap and the second gap, such that a third extension section is surroundingly arranged below the third wire-fixing portion. An extension direction of the conductive cable is perpendicular to a mating direction of the mating connector and the wire-clamping connector.

10 Claims, 15 Drawing Sheets

M

WIRE-CLAMPING CONNECTOR ASSEMBLY

CROSS-REFERENCE TO RELATED PATENT APPLICATION

This application claims the benefit of priority to Taiwan Patent Application No. 110207347, filed on Jun. 25, 2021. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a wire-clamping connector assembly, and more particularly to a wire-clamping connector assembly that is adapted for automatic assembly.

BACKGROUND OF THE DISCLOSURE

Conventionally, conductive terminals are formed in a plastic shell by insert molding, and the conductive terminals are soldered onto a conductive cable (e.g., a flexible flat cable (FFC)), so that external signal connection can be achieved by a wire-to-board connector. However, such a process is unfavorable for reducing a manufacturing cost.

Therefore, reducing a quantity of connecting elements between the conductive cable and the wire-to-board connector and simplifying a manufacturing process through an improvement in structural design, so as to overcome the above-mentioned problems, has become one of the important issues to be addressed in the related art.

SUMMARY OF THE DISCLOSURE

In response to the above-referenced technical inadequacies, the present disclosure provides a wire-clamping connector assembly.

In one aspect, the present disclosure provides a wire-clamping connector assembly, which mainly includes a wire-clamping connector and a mating connector. The wire-clamping connector includes a casing and a conductive cable. The casing includes a first side wall and a second side wall that are opposite to each other, and a first wire-fixing portion, a second wire-fixing portion, and a third wire-fixing portion that are arranged between the first side wall and the second side wall. The third wire-fixing portion is located between the first wire-fixing portion and the second wire-fixing portion, a first gap is formed between the first wire-fixing portion and the third wire-fixing portion, and a second gap is formed between the second wire-fixing portion and the third wire-fixing portion. The first wire-fixing portion has a first surface, the second wire-fixing portion has a second surface, and the first surface and the second surface are coplanar. The conductive cable is arranged on the casing along a first direction, and includes a first insulating body, a second insulating body, and a conductive cable body. The conductive cable body has a first extension section, a second extension section, and a third extension section, and the third extension section is connected between the first extension section and the second extension section. The first insulating body covers a top surface of the conductive cable body, and the second insulating body covers bottom surfaces of the first extension section and the second extension section of the conductive cable body, such that a bottom surface of the third extension section is exposed. When the conductive cable is disposed on the casing, the conductive cable passes through the first gap and the second gap, such that the first extension section is arranged on the first surface, a part of the second extension section is arranged on the second surface, and the third extension section is surroundingly arranged below the third wire-fixing portion. The mating connector is configured to be mated with the wire-clamping connector along a second direction, and the second direction is perpendicular to the first direction.

Therefore, in the wire-clamping connector assembly provided by the present disclosure, through the technical features of "when the conductive cable is disposed on the casing, the conductive cable passes through the first gap and the second gap, such that the first extension section is arranged on the first surface, a part of the second extension section is arranged on the second surface, and the third extension section is surroundingly arranged below the third wire-fixing portion" and "the conductive cable is arranged on the casing along a first direction, the mating connector is mated with the wire-clamping connector along a second direction, and the second direction is perpendicular to the first direction," the conductive cable is directly arranged in the casing, so as to replace conductive terminals inside a conventional wire-to-board connector. In this way, a material cost can be reduced, and a manufacturing process can be simplified.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
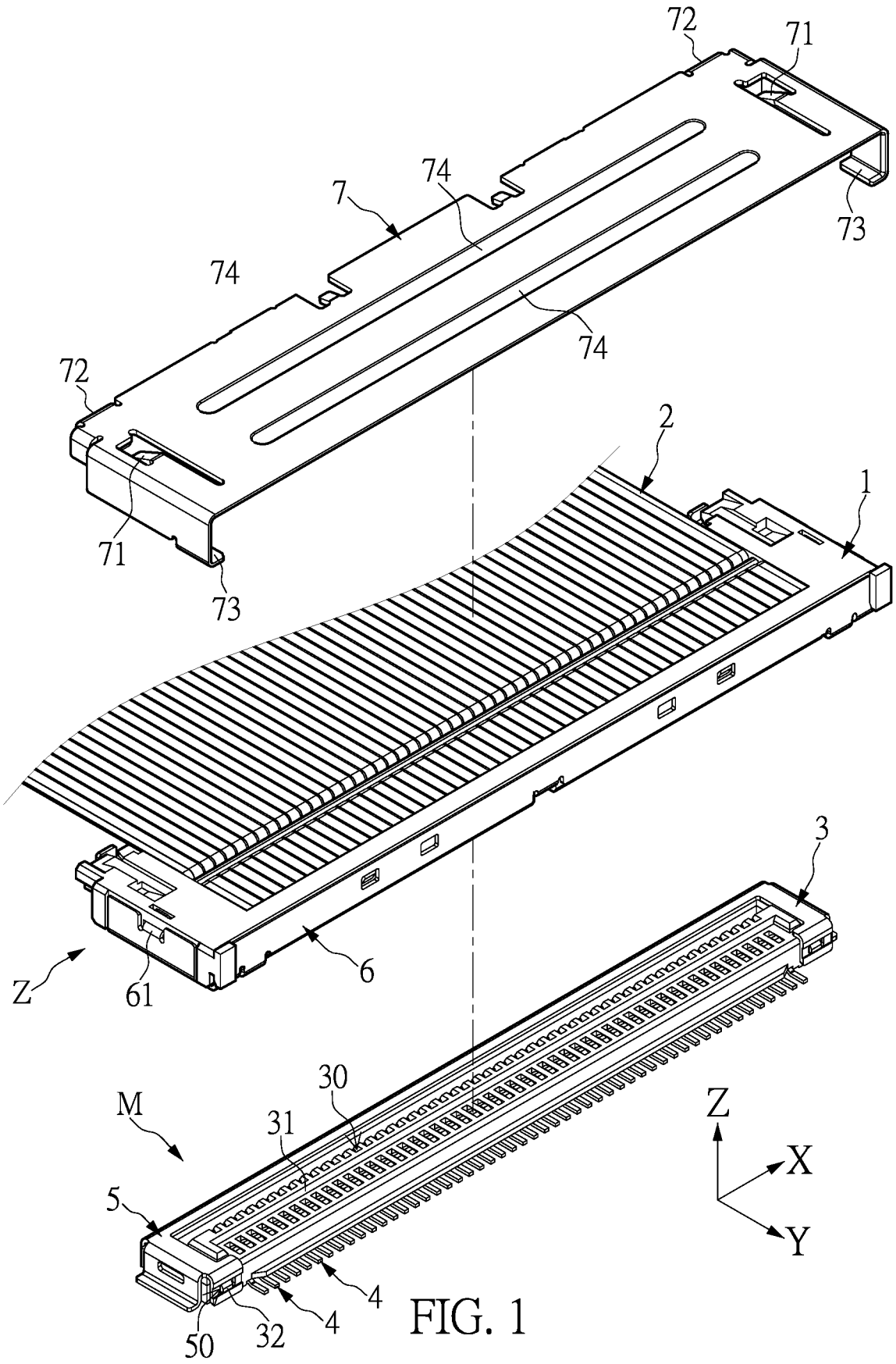
FIG. 1 is a schematic perspective view of a wire-clamping connector assembly according to the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Embodiment

As shown in FIG. 1, an embodiment of the present disclosure provides a wire-clamping connector assembly, which mainly includes a wire-clamping connector Z and a mating connector M. Specifically, the wire-clamping connector assembly can further include a first outer frame member 5, a ring-shaped frame member 6, and a second outer frame member 7. The first outer frame member 5 can be assembled with the mating connector M, the ring-shaped frame member 6 can be assembled with the wire-clamping connector Z, and the second outer frame member 7 can be assembled with the wire-clamping connector Z and the mating connector M that are mated with each other. When the wire-clamping connector Z is mated with the mating connector M, the first outer frame member 5 and the ring-shaped frame member 6 can structurally interfere with each other (not shown in the drawings). Due to the presence of the second outer frame member 7, an overall structural strength of the wire-clamping connector assembly is enhanced, and contact between the wire-clamping connector Z and the mating connector M is improved. It should be noted that how the first outer frame member 5 and the ring-shaped frame member 6 structurally interfere with each other is not limited in the present disclosure. For example, the first outer frame member 5 and the ring-shaped frame member 6 can interfere with each other in an engaging manner, an abutting manner, or a fastening manner (but not limited thereto). The wire-clamping connector Z includes a casing 1 and a conductive cable 2. The conductive cable 2 is arranged on the casing 1 along a first direction (i.e., a positive Y-axis direction). In addition, it should be noted that, the mating connector M is mated with the wire-clamping connector Z along a second direction (i.e., a negative Z-axis direction), and the second direction is perpendicular to the first direction. In other words, a mating direction (mating in an up-down direction along a Z-axis) of the wire-clamping connector Z and the mating connector M is perpendicular to an extension direction (extending along a Y-axis) of the conductive cable 2.

Figure 2:
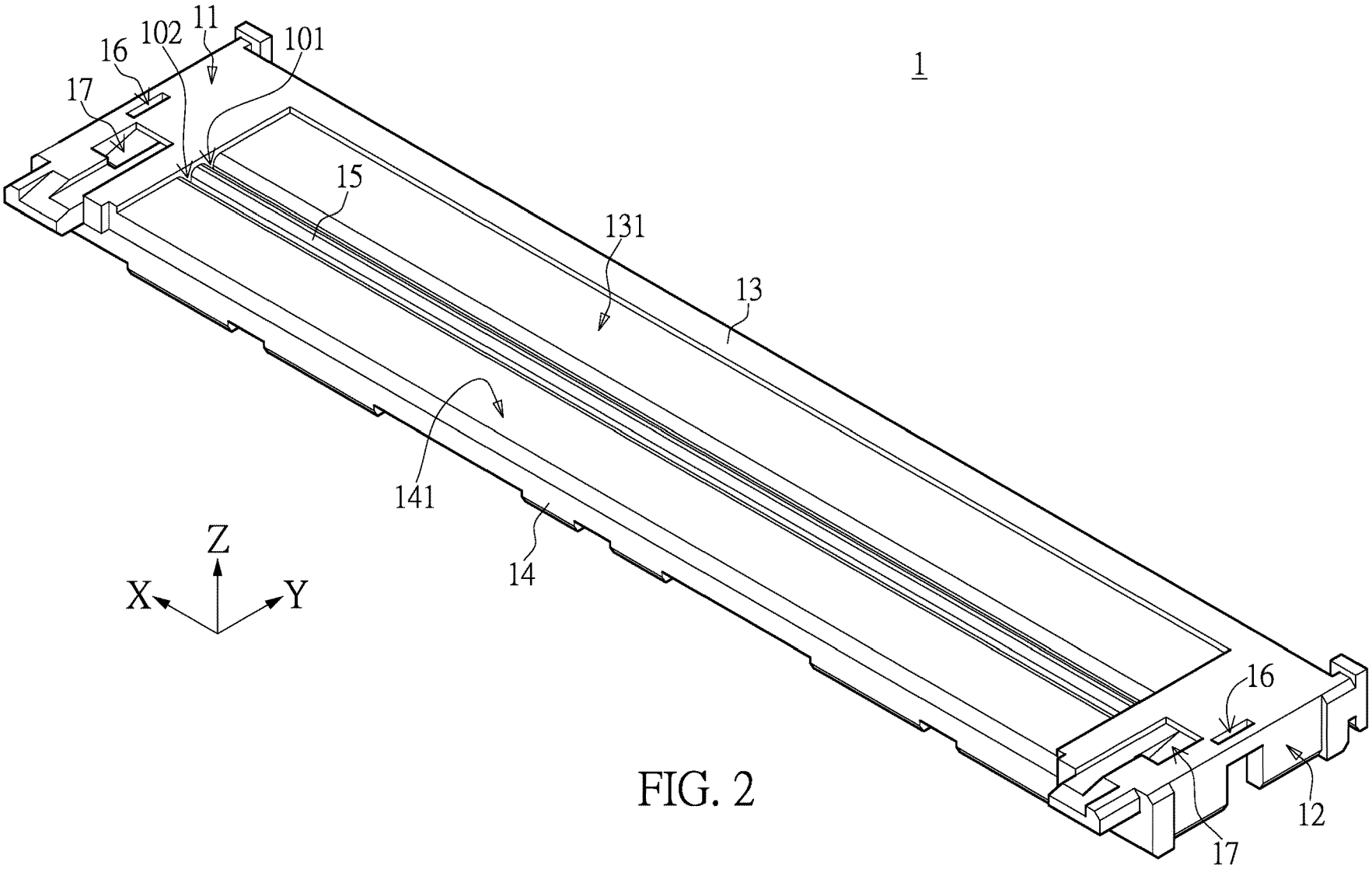
FIG. 2 is a schematic perspective view of a casing of a wire-clamping connector according to the present disclosure.
Figure 3:
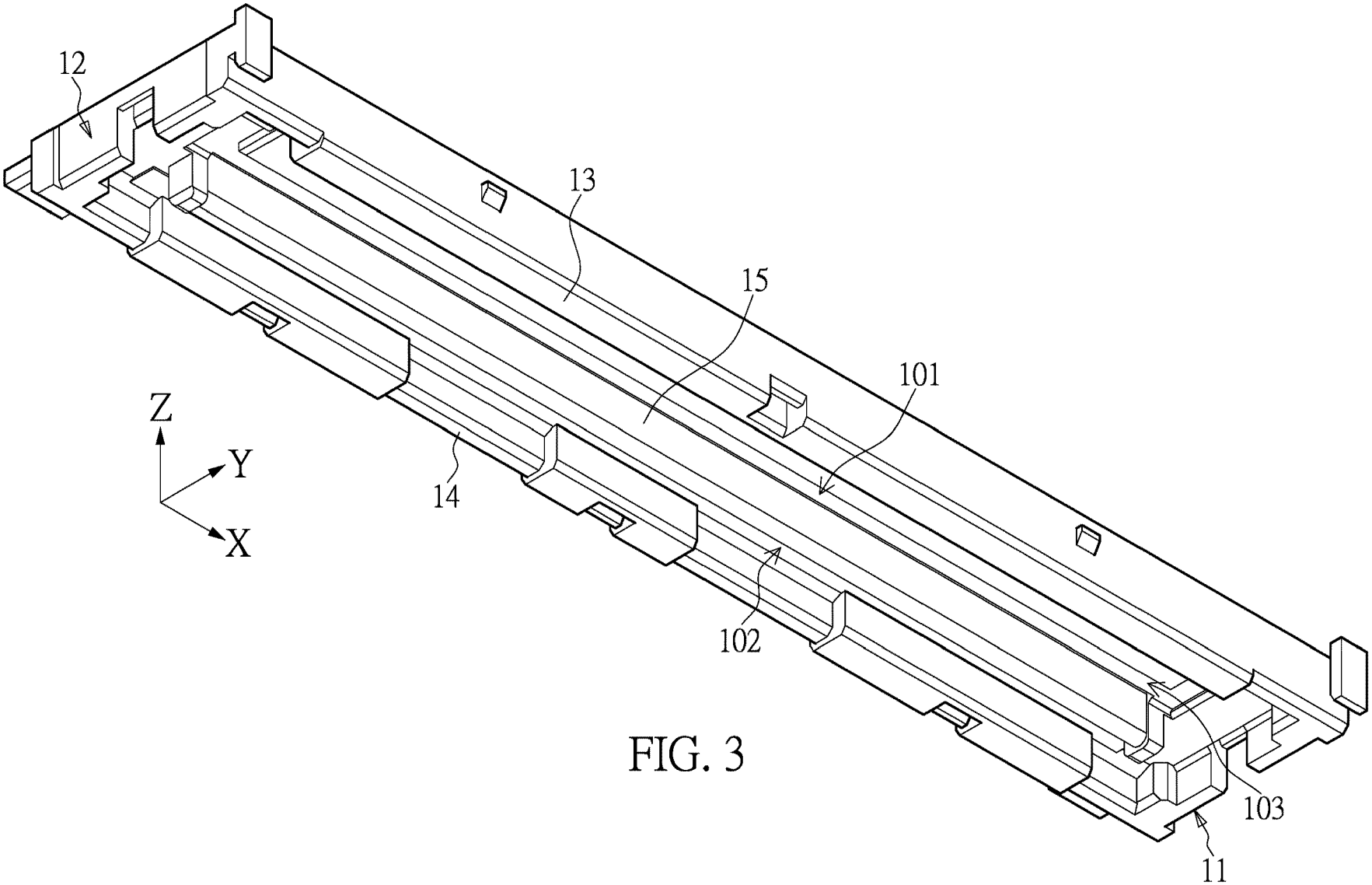
FIG. 3 is another schematic perspective view of the casing of the wire-clamping connector according to the present disclosure.

Reference is made to FIG. 2 and FIG. 3, which are schematic perspective views of a casing of a wire-clamping connector according to the present disclosure from different angles of view. The casing 1 includes a first side wall 11 and a second side wall 12 that are opposite to each other, and a first wire-fixing portion 13, a second wire-fixing portion 14, and a third wire-fixing portion 15 that are arranged between the first side wall 11 and the second side wall 12. The third wire-fixing portion 15 is located between the first wire-fixing portion 13 and the second wire-fixing portion 14, a first gap 101 is formed between the first wire-fixing portion 13 and the third wire-fixing portion 15, and a second gap 102 is formed between the second wire-fixing portion 14 and the third wire-fixing portion 15. The first wire-fixing portion 13 has a first surface 131, and the second wire-fixing portion 14 has a second surface 141. It is worth mentioning that the first surface 131 and the second surface 141 are coplanar.

Figure 4:
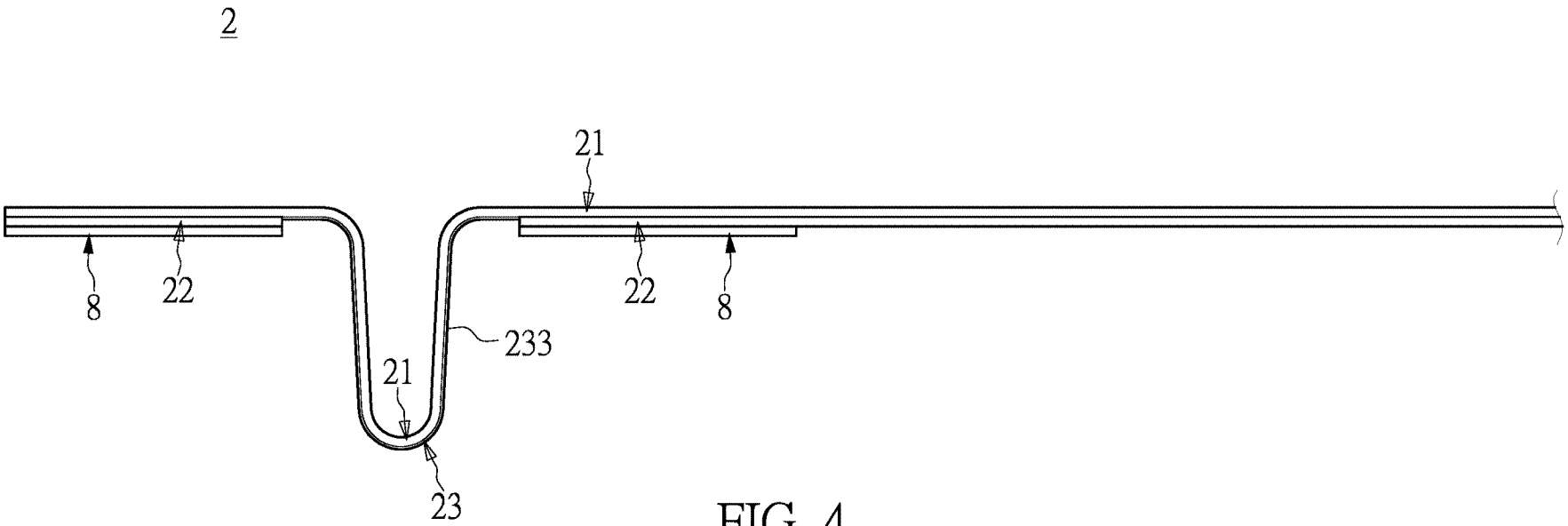
FIG. 4 is a schematic side view of a conductive cable of the wire-clamping connector according to the present disclosure.
Figure 5:
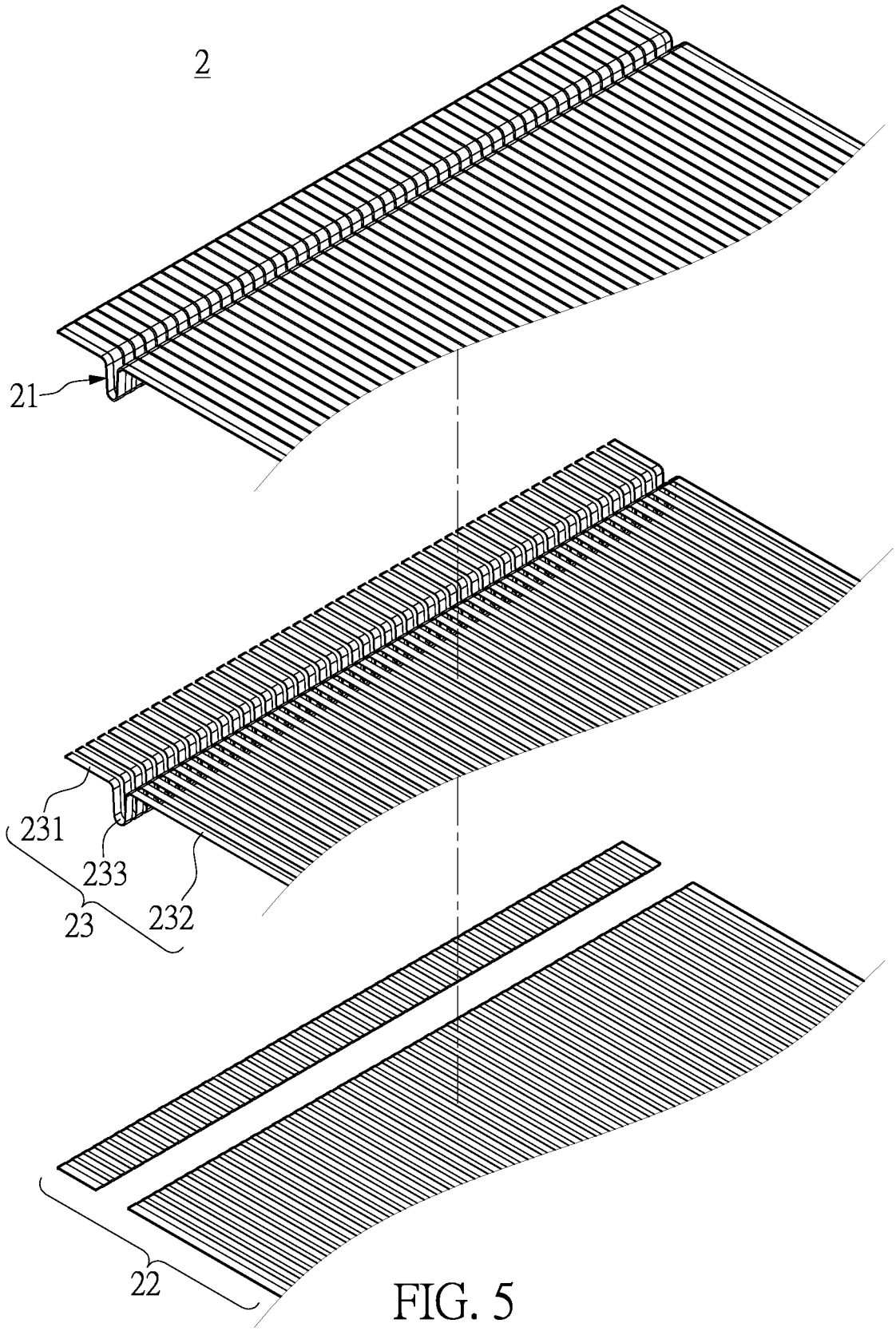
FIG. 5 is a schematic exploded view of the conductive cable of the wire-clamping connector according to the present disclosure.
Figure 6:
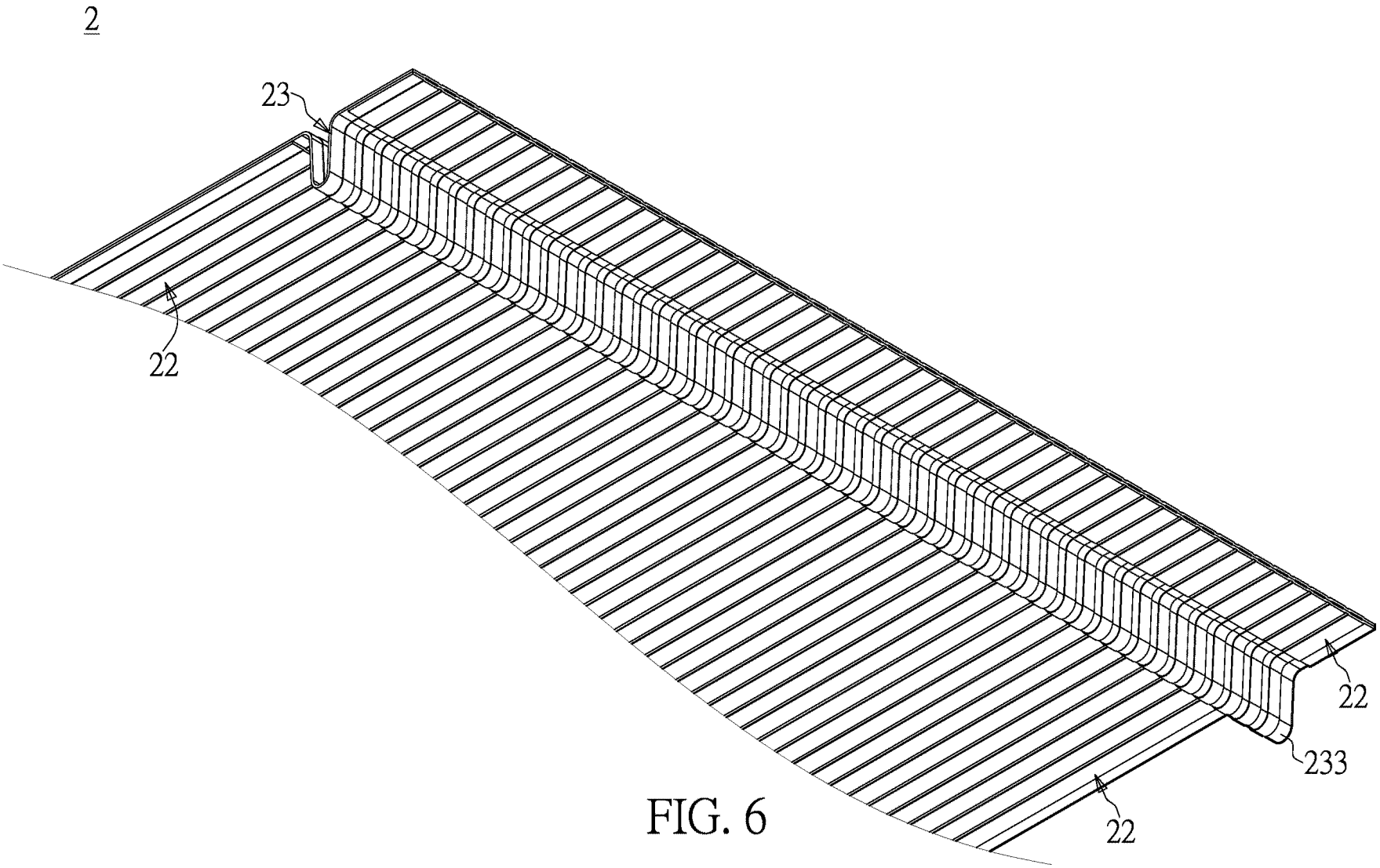
FIG. 6 is a schematic perspective view of the conductive cable of the wire-clamping connector according to the present disclosure.

Referring to FIG. 4 to FIG. 6, FIG. 4 is a schematic side view of a conductive cable of the wire-clamping connector according to the present disclosure, FIG. 5 is a schematic exploded view of the conductive cable of the wire-clamping connector according to the present disclosure, and FIG. 6 is a schematic perspective view of the conductive cable of the wire-clamping connector according to the present disclosure. The conductive cable 2 includes a first insulating body 21, a second insulating body 22, and a conductive cable body 23. The conductive cable body 23 has a first extension section 231, a second extension section 232, and a third extension section 233, and the third extension section 233 is connected between the first extension section 231 and the second extension section 232. The first insulating body 21 completely covers a top surface of the conductive cable body 23, and the second insulating body 22 covers bottom surfaces of the first extension section 231 and the second extension section 232 of the conductive cable body 23, such that a bottom surface of the third extension section 233 of the conductive cable body 23 is exposed. That is to say, a bottom surface of a middle section of the conductive cable body 23 is not covered by the insulating bodies, and a contact region is formed. Therefore, when the conductive cable 2 is disposed on the casing 1, the conductive cable 2 passes through the first gap 101 and the second gap 102, such that the first extension section 231 is arranged on the first surface 131 of the first wire-fixing portion 13, a part of the second extension section 232 is arranged on the second surface 141 of the second wire-fixing portion 14, and the third extension section 233 is surroundingly arranged below the third wire-fixing portion 15. Then, reference is made to FIG. 7, which is a schematic perspective view of the wire-clamping connector of the wire-clamping connector assembly according to the present disclosure. The conductive cable 2 is fixed to the casing 1 by passing through the third wire-fixing portion 15. More specifically, the wire-clamping connector assembly further includes at least one adhesive 8. When the conductive cable 2 is disposed on the casing 1, the at least one adhesive 8 can be arranged between the second insulating body 22 and the first surface 131 or between the second insulating body 22 and the second surface 141. In other words, the adhesive 8 can be pasted between the second insulating body 22 and the first surface 131, and the adhesive 8 can also be pasted between the second insulating body 22 and the second surface 141. Preferably, the adhesive 8 is a double-sided adhesive. The double-sided adhesive allows the conductive cable 2 to be further fixed to the casing 1.

Figure 7:
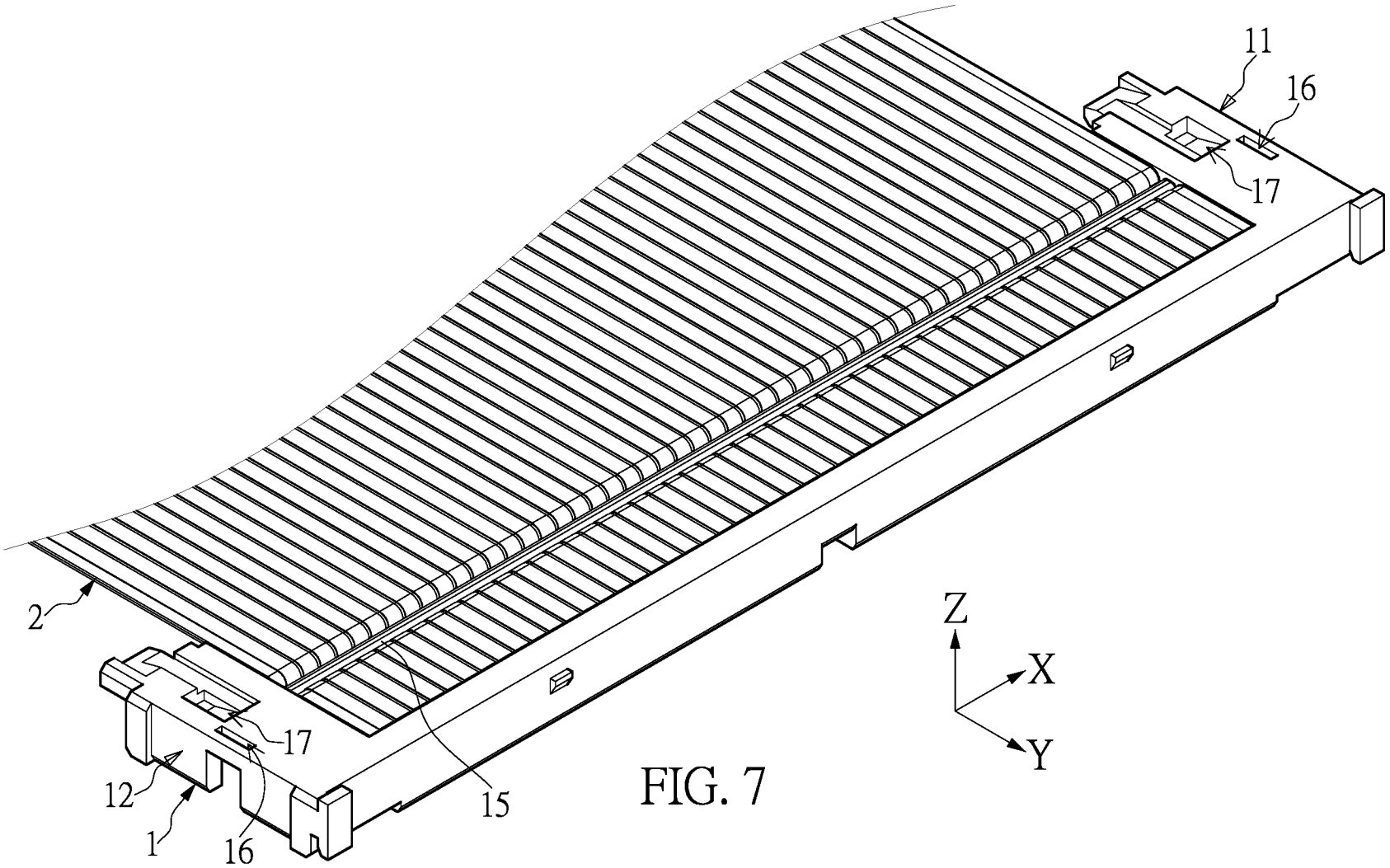
FIG. 7 is a schematic perspective view of the wire-clamping connector of the wire-clamping connector assembly according to the present disclosure.

Referring to FIG. 2 and FIG. 7, the wire-clamping connector Z provided in the present disclosure allows the conductive cable 2 (for example, but not limited to, a flexible flat cable (FFC)) to be directly fixed to the casing 1, and can be used to replace a conventional wire-clamping connector that needs internal conductive terminals to be electrically connected to external conductive terminals. In this way, not only is the required material cost reduced, but a manufacturing process is also simplified, thereby improving productivity. In the present disclosure, during an assembling process of the wire-clamping connector Z, one surface of the double-sided adhesive (i.e., the adhesive 8) with a plastic film removed therefrom is firstly adhered to a bottom surface of the second insulating body 22 of the conductive cable 2. Then, the conductive cable 2 passes through the second gap 102 from up to down (i.e., the negative Z-axis direction). After bypassing the third wire-fixing portion 15, the conductive cable 2 passes through the first gap 101 from down to up (i.e., a positive Z-axis direction). Accordingly, the conductive cable 2 is arranged on the casing 1 along the first direction (i.e., the positive Y-axis direction) when viewed from the perspective of the overall extension direction of the conductive cable 2. Another surface of the double-sided adhesive (i.e., the adhesive 8), after removing its plastic film, is adhered to the first surface 131 and the second surface 141 of the casing 1, so as to fix the conductive cable 2 to the casing 1.

Figure 8:
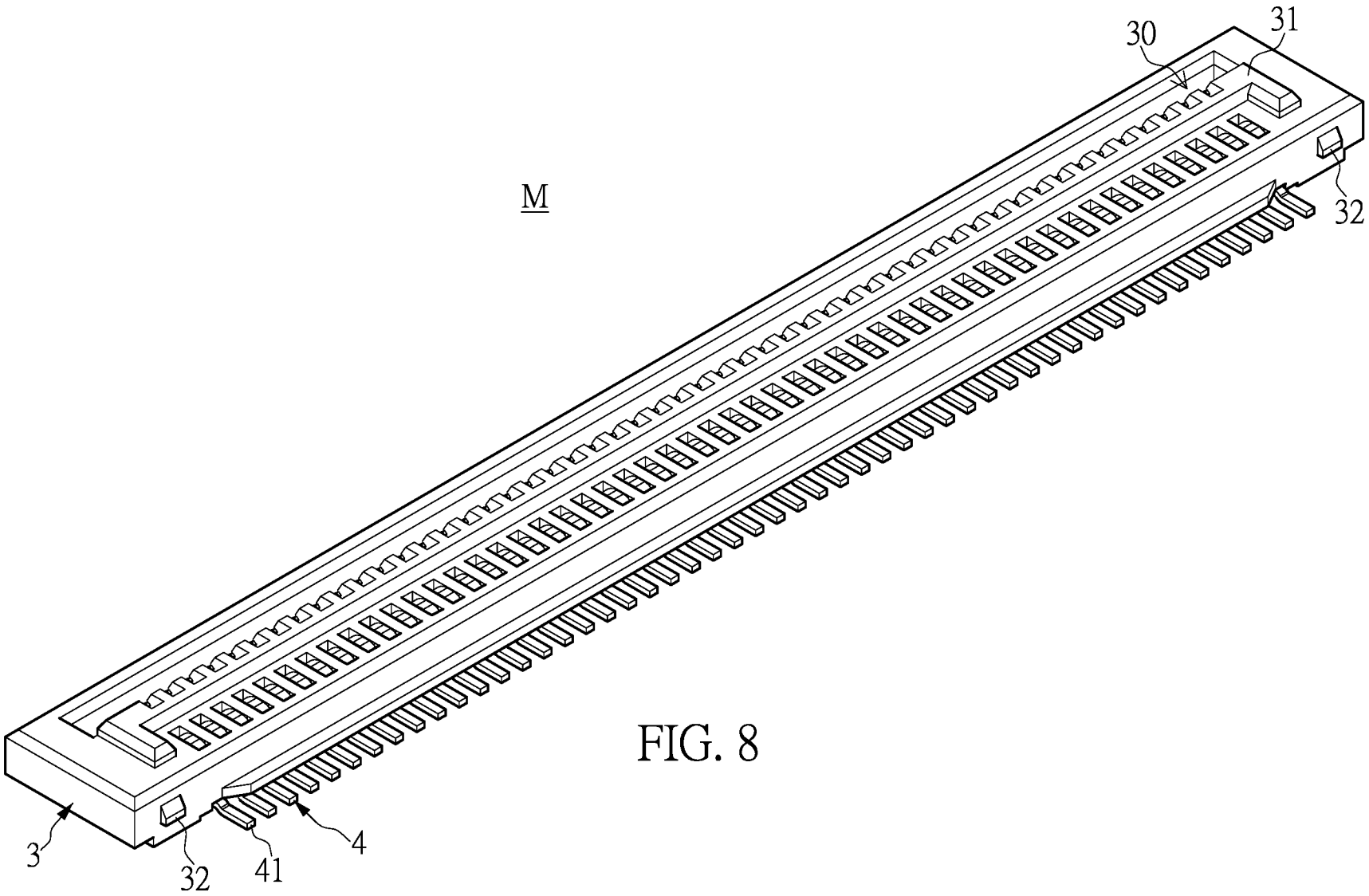
FIG. 8 is a schematic perspective view of a mating connector of the wire-clamping connector assembly according to the present disclosure.
Figure 9:
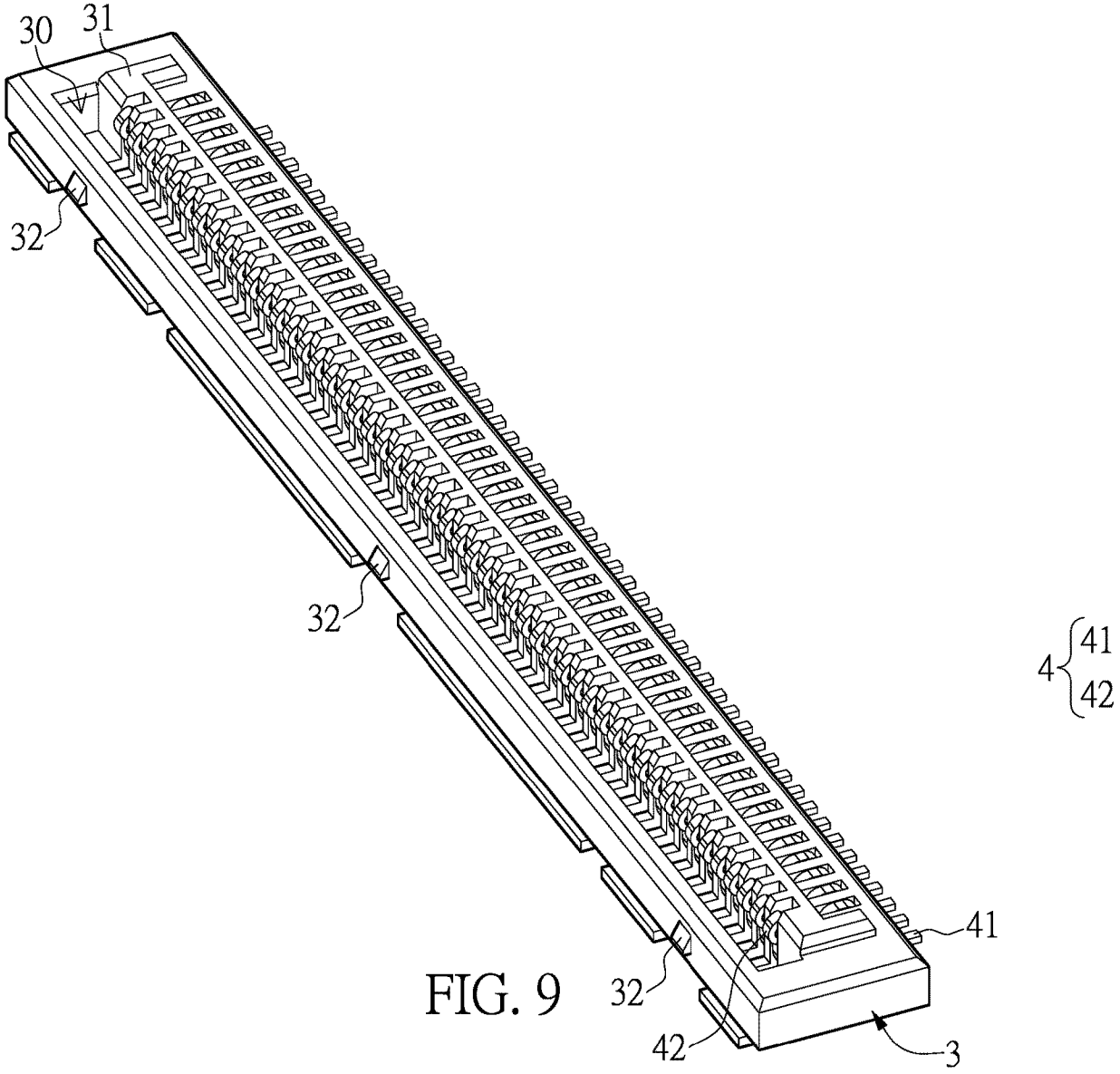
FIG. 9 is another schematic perspective view of the mating connector of the wire-clamping connector assembly according to the present disclosure.

Referring to FIG. 1, FIG. 8 and FIG. 9, FIG. 8 and FIG. 9 are schematic perspective views of a mating connector of the wire-clamping connector assembly according to the present disclosure from different angles of view. The mating connector M is configured to be mated with the wire-clamping connector Z. The mating connector M includes a main body 3 and a plurality of conductive terminals 4, and the conductive terminals 4 are arranged at fixed intervals and are embedded in the main body 3. A retaining groove 30 is formed on a surface of the main body 3 that faces toward the wire-clamping connector Z. Each of the conductive terminals 4 has one of a plurality of pins 41 and one of a plurality of contact portions 42. The pins 41 extend outwardly and are exposed from the main body 3 for being soldered onto a circuit board (not shown in the drawings). The contact portions 42 are exposed in the retaining groove 30. To be more specific, a limiting groove 103 is formed on a side of the casing 1 of the wire-clamping connector Z that faces toward the main body 3. The main body 3 of the mating connector M further includes an alignment protrusion 31, and the alignment protrusion 31 is adjacent to the retaining groove 30. When the mating connector M is mated with the wire-clamping connector Z, the alignment protrusion 31 is fitted into the limiting groove 103, and the third wire-fixing portion 15 of the casing 1 is inserted into the retaining groove 30, such that the conductive cable body 23 of the conductive cable 2 is in electrical contact with the contact portions 42 (reference can be made to FIG. 15, which shows how the conductive cable 23 is in electrical contact with the contact portions 42).

Figure 10:
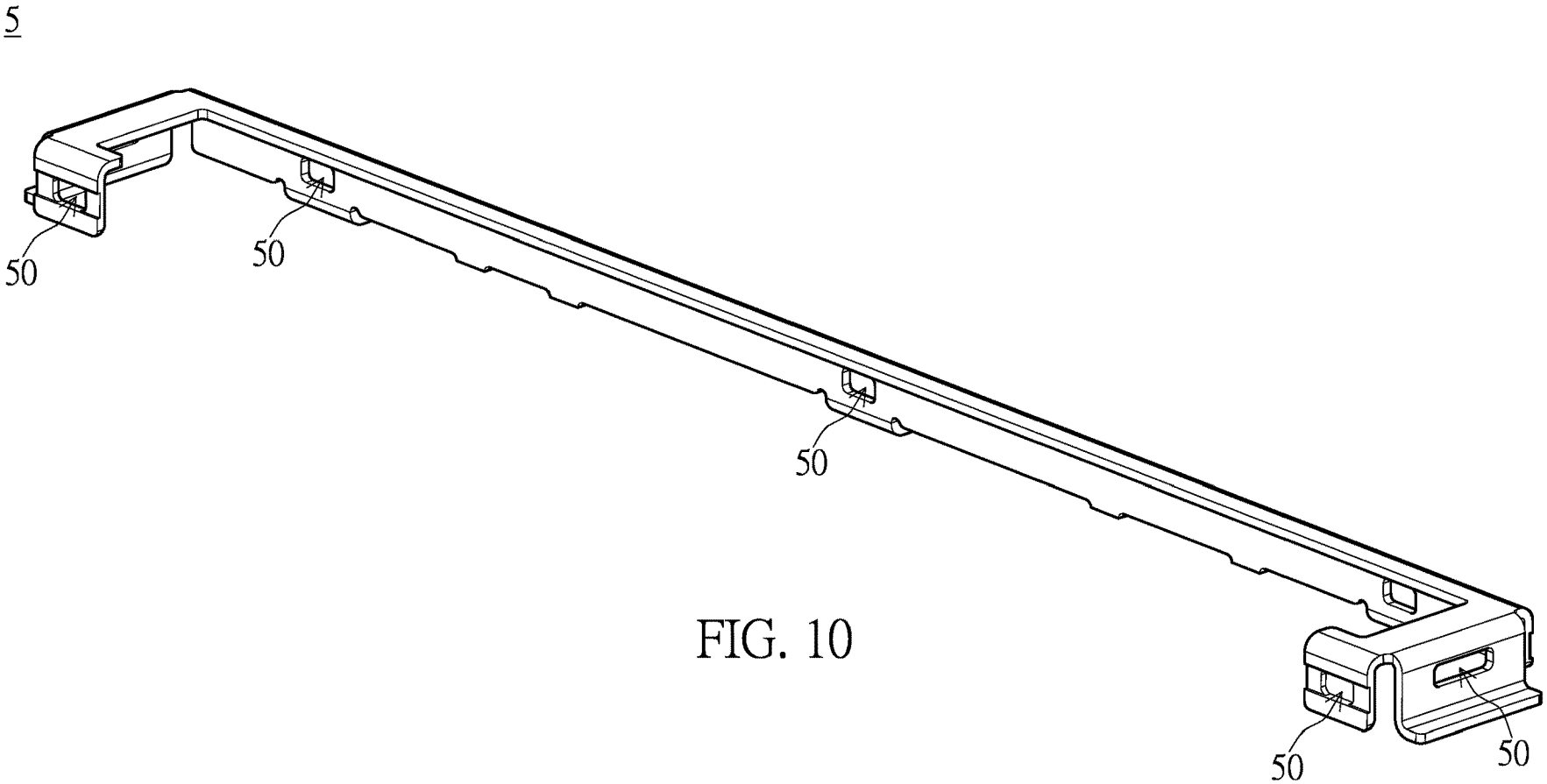
FIG. 10 is a schematic perspective view of a first outer frame member of the wire-clamping connector assembly according to the present disclosure.

Referring to FIG. 9 and FIG. 10, FIG. 10 is a schematic perspective view of a first outer frame member of the wire-clamping connector assembly according to the present disclosure. The first outer frame member 5 is in the shape of an inverted letter "U", and is disposed on the main body 3 of the mating connector M. Specifically, the first outer frame member 5 has at least one groove hole 50, and the main body 3 further includes at least one tenon 32 that corresponds to the at least one groove hole 50. When the first outer frame member 5 is disposed on the main body 3 of the mating connector M, the at least one tenon 32 is fitted into the at least one groove hole 50. It should be noted that a quantity of the groove hole 50 and a quantity of the tenon 32 are not limited in the present disclosure.

Figure 11:
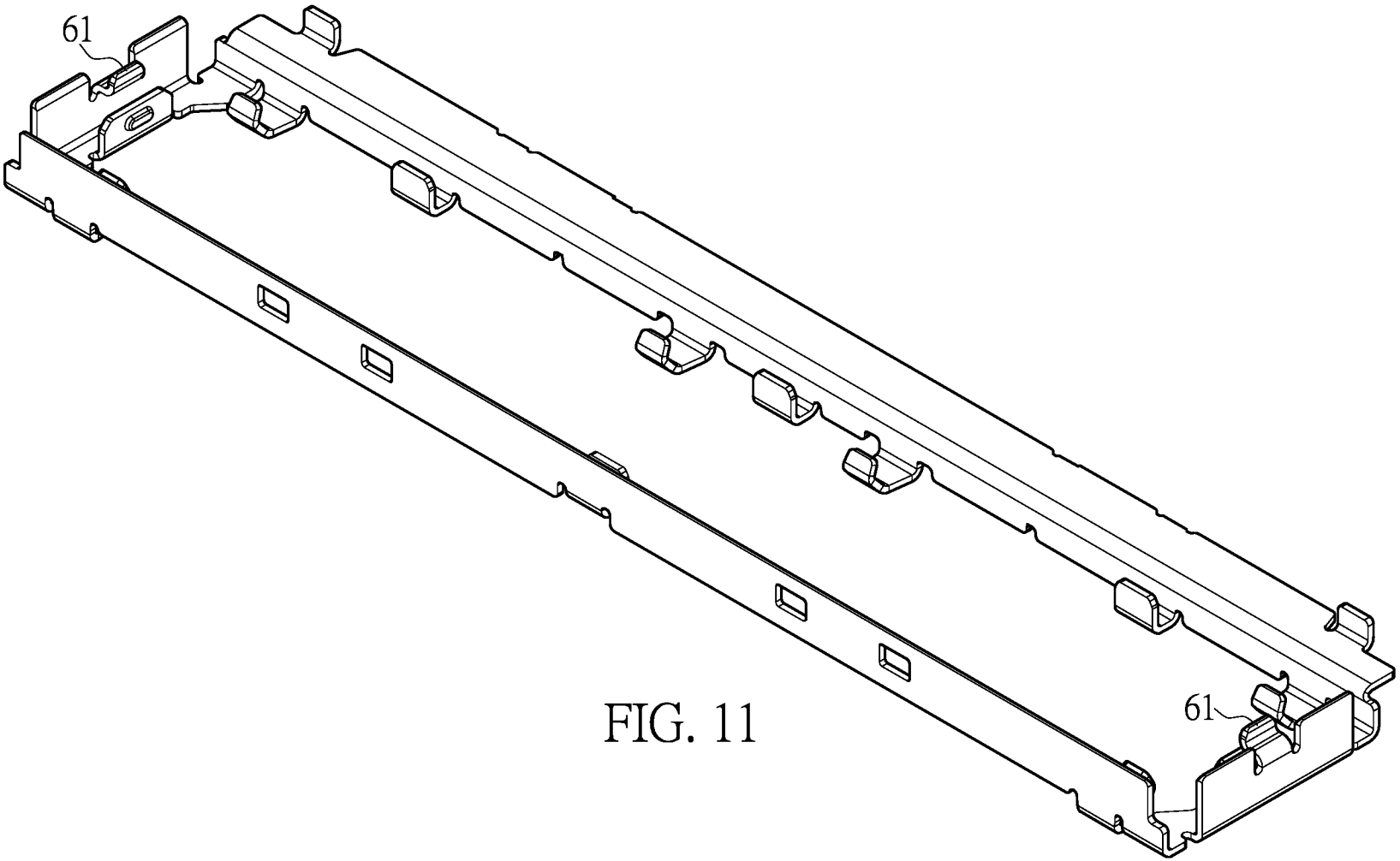
FIG. 11 is a schematic perspective view of a ring-shaped frame member of the wire-clamping connector assembly according to the present disclosure.

Referring to FIG. 7 and FIG. 11, FIG. 11 is a schematic perspective view of a ring-shaped frame member of the wire-clamping connector assembly according to the present disclosure. The ring-shaped frame member 6 is disposed on the casing 1 of the wire-clamping connector Z. Two protruding portions 61 are formed on two sides of the ring-shaped frame member 6, respectively. Two through holes 16 that correspond to the two protruding portions 61 are formed in the first side wall 11 and the second side wall 12 of the casing 1, respectively. When the mating connector M is mated with the wire-clamping connector Z, each of the protruding portions 61 is inserted into a corresponding one of the through holes 16.

Figure 12:
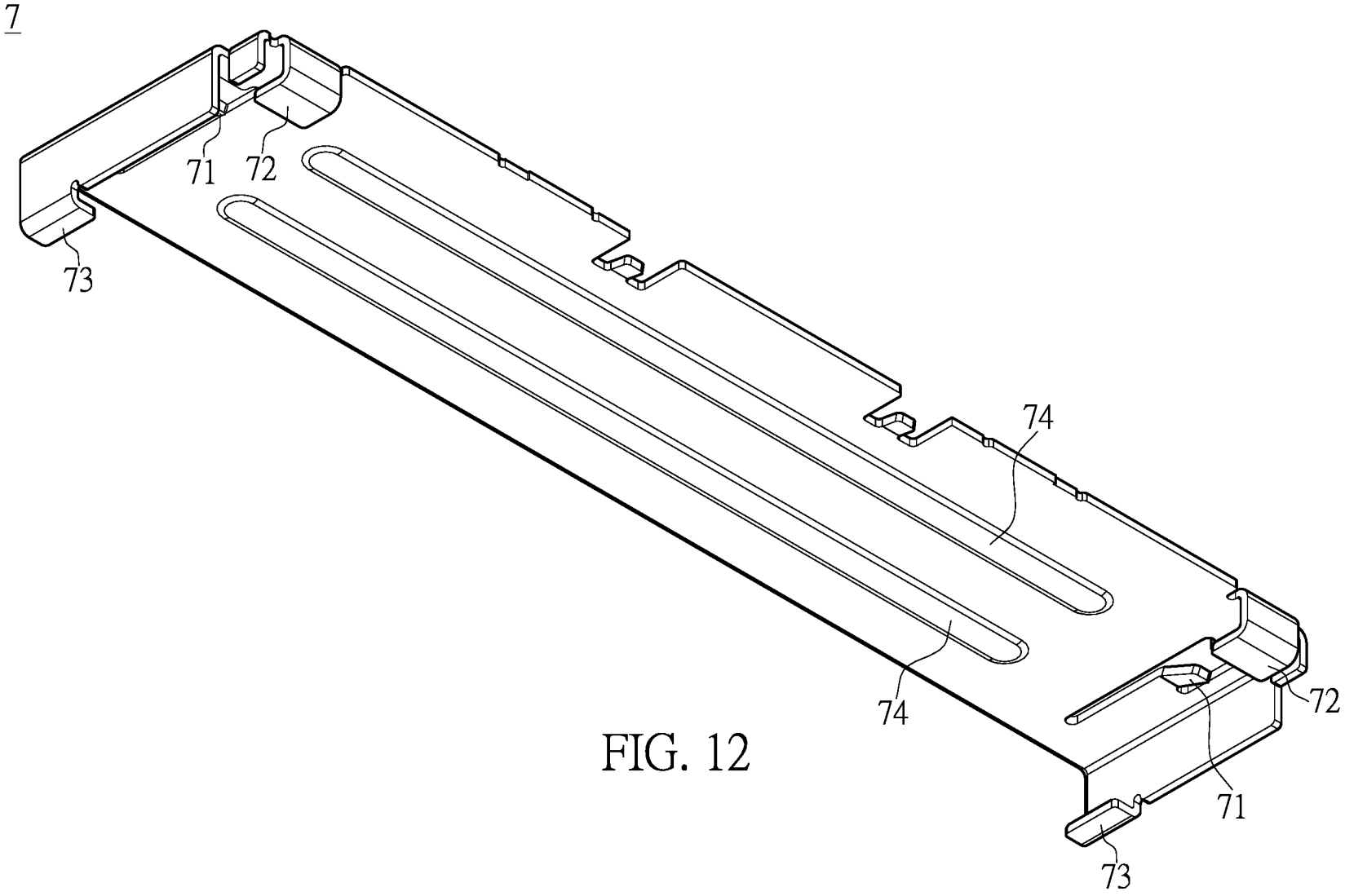
FIG. 12 is a schematic perspective view of a second outer frame member of the wire-clamping connector assembly according to the present disclosure.
Figure 13:
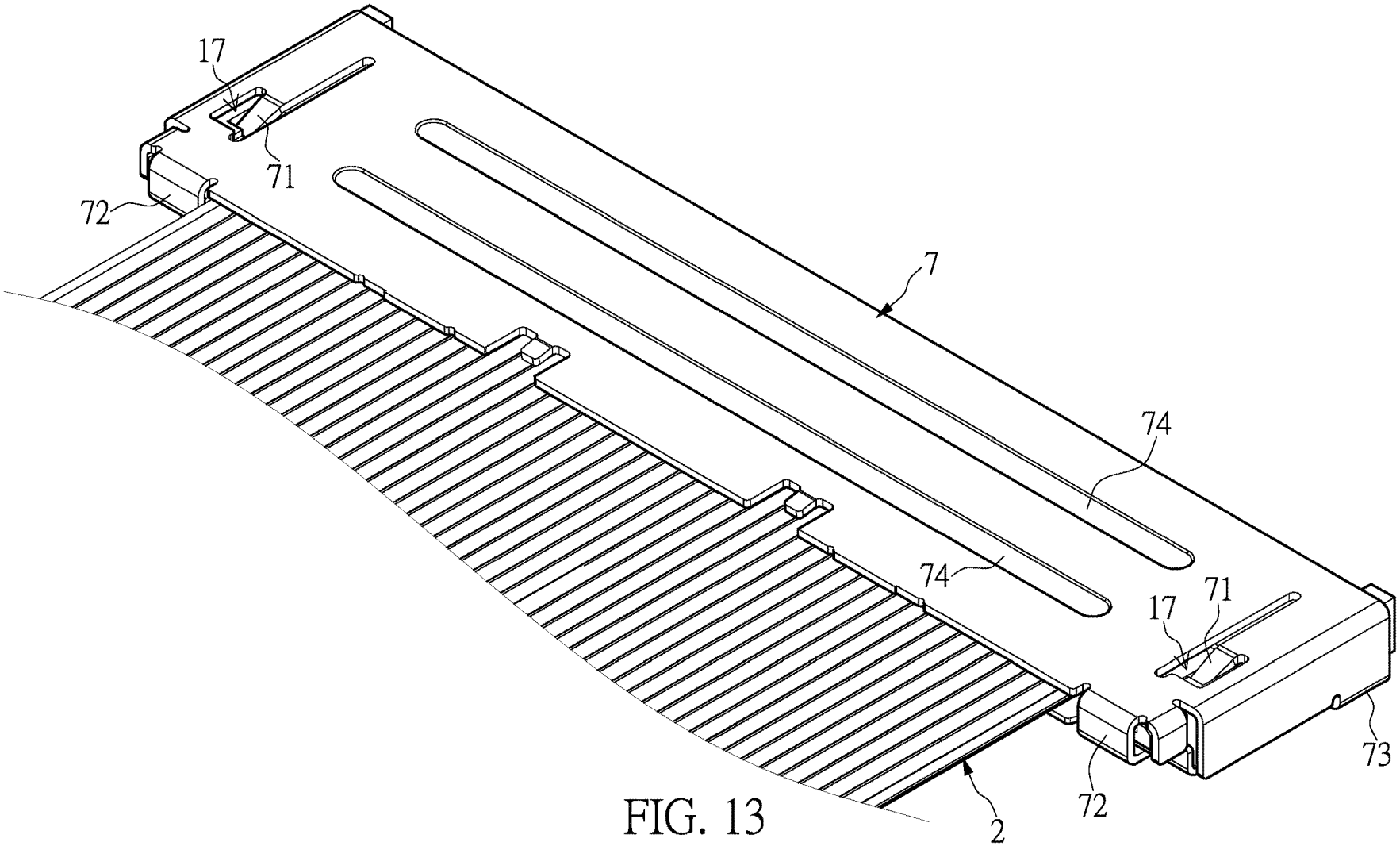
FIG. 13 is a schematic perspective view of the wire-clamping connector assembly according to the present disclosure.
Figure 14:
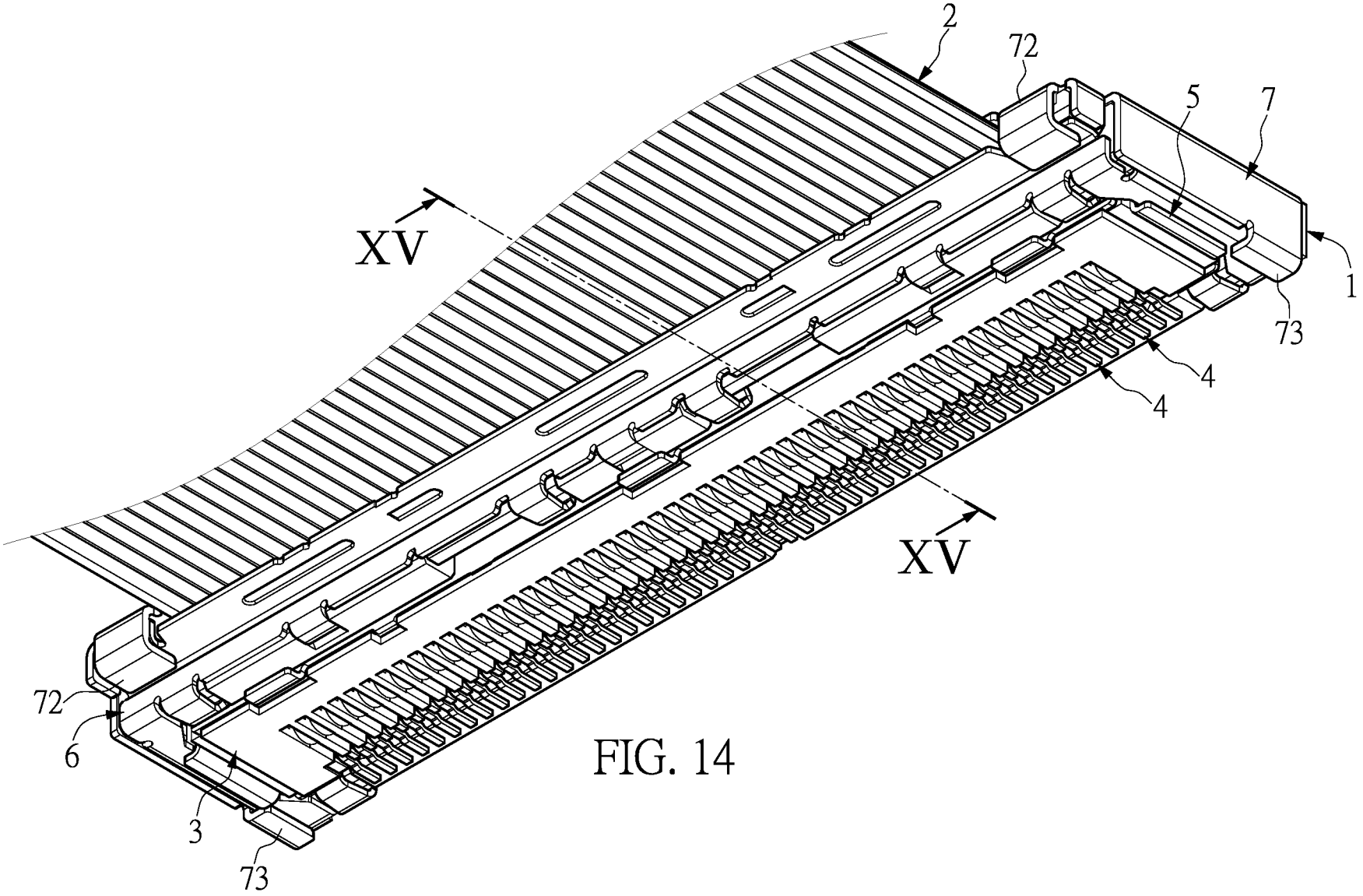
FIG. 14 is another schematic perspective view of the wire-clamping connector assembly according to the present disclosure.

Referring to FIG. 12 to FIG. 14, FIG. 12 is a schematic perspective view of a second outer frame member of the wire-clamping connector assembly according to the present disclosure, and FIG. 13 and FIG. 14 are schematic perspective views of the wire-clamping connector assembly according to the present disclosure from different angles of view. Specifically, the second outer frame member 7 covers the wire-clamping connector Z, the mating connector M, the first outer frame member 5, and the ring-shaped frame member 6. The second outer frame member 7 includes two cantilever members 71, and two grooves 17 that correspond to the two cantilever members 71 are formed on the first side wall 11 and the second side wall 12 of the casing 1, respectively. When the second outer frame member 7 covers the wire-clamping connector Z and the mating connector M that are mated with each other, each of the cantilever members 71 is fitted into a corresponding one of the grooves 17. Furthermore, the second outer frame member 7 further includes at least one first hook member 72 and at least one second hook member 73. When the second outer frame member 7 covers the wire-clamping connector Z and the mating connector M that are mated with each other, the at least one first hook member 72 is engaged with an end of the first side wall 11 or an end of the second side 12 wall of the casing 1 of the wire-clamping connector Z, and the at least one second hook member 73 is engaged with bottom portions of two sides of the main body 3 of the mating connector M. In this way, a normal force between the wire-clamping connector Z and the mating connector M during mating can be increased, and the overall structural strength of the wire-clamping connector assembly can be improved. It should be noted that quantities of the first hook member 72 and the second hook member 73 are not limited in the present disclosure.

Figure 15:
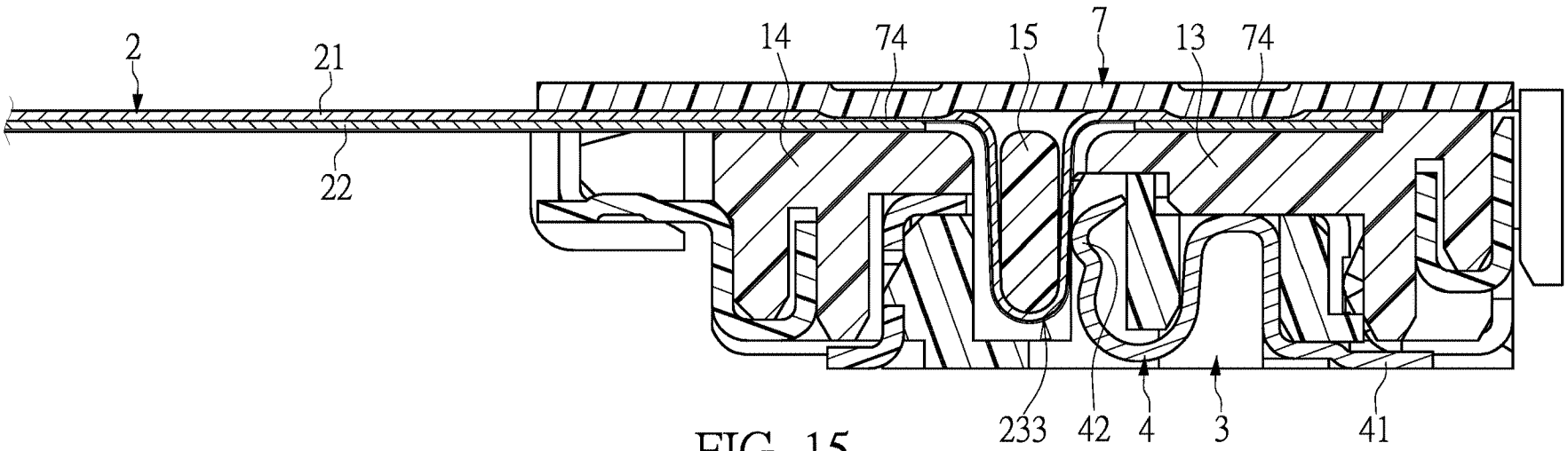
FIG. 15 is a schematic cross-sectional view taken along line XV-XV of FIG. 14.

Reference is further made to FIG. 14 and FIG. 15, in which FIG. 15 is a schematic cross-sectional view taken along line XV-XV of FIG. 14. To keep the drawings clear and convenient for illustration purposes, the double-sided adhesive (i.e., the adhesive 8) is not shown in FIG. 15. From the previous descriptions, a relative position of the double-sided adhesive (i.e., the adhesive 8) in FIG. 15 should be obvious to those skilled in the art and will not be reiterated herein. Two press-contact portions 74 are formed on a surface of the second outer frame member 7. The press-contact portion 74 is a strip-shaped protruding structure that protrudes downwardly (i.e., the negative Z-axis direction). When the wire-clamping connector is mated with the mating connector M and the second outer frame member 7 is placed over the wire-clamping connector Z, the two press-contact portions 74 press against a top surface of the first insulating body 21 of the conductive cable 2. More specifically, the two press-contact portions 74 are respectively positioned above the first extension section 231 and the second extension section 232 of the conductive cable body 23 of the conductive cable 2. Accordingly, the conductive cable 2 can be further fixed. The bottom surface of the third extension section 233 that is not covered by the insulating bodies faces toward the mating connector M, such that the conductive cable 2 contacts the contact portions 42 of the conductive terminals 4 through the third extension section 233. To be more specific, since the conductive cable 2 passes through the first gap 101 and the second gap 102, the third extension section 233 is surroundingly arranged below the third wire-fixing portion 15, and a contact surface of the third extension section 233 that contacts the contact portions 42 is perpendicular to the extension direction of the conductive cable 2. Therefore, through the third extension section 233, the conductive cable 2 can be in electrical contact with the contact portions 42 of the conductive terminals 4 along a horizontal contact direction (i.e., a Y-axis direction). That is to say, the contact direction (i.e., the Y-axis direction) of the conductive cable 2 and the conductive terminals 4 is perpendicular to the mating direction (i.e., a Z-axis direction) of the wire-clamping connector Z and the mating connector M.

Beneficial Effects of the Embodiment

In conclusion, in the wire-clamping connector assembly provided by the present disclosure, when the conductive cable 2 is disposed on the casing 1, the conductive cable 2 passes through the first gap 101 and the second gap 102, such that the first extension section 231 is arranged on the first surface 131, a part of the second extension section 232 is arranged on the second surface 141, and the third extension section 233 is surroundingly arranged below the third wire-fixing portion 15. The conductive cable 2 (for example, but not limited to, a flexible flat cable (FFC)) is directly fixed to the casing 1, and such a configuration can be used for replacing the conventional wire-clamping connector that needs internal conductive terminals to be electrically connected to external conductive terminals. In this way, not only is the material cost reduced (e.g., the conductive terminals), but the manufacturing process is also simplified (omitting the conductive terminals means that an insert molding process required for manufacturing the conductive terminals is not necessary), thereby improving the productivity.

More specifically, the bottom surface of the third extension section 233 (at the middle section) of the conductive cable body 23 is exposed and not covered by the insulating bodies. When the conductive cable 2 is disposed on the casing 1, the conductive cable 2 passes through the first gap 101 and the second gap 102, such that the first extension section 231 is arranged on the first surface 131 of the first wire-fixing portion 13, a part of the second extension section 232 is arranged on the second surface 141 of the second wire-fixing portion 14, and the third extension section 233 is surroundingly arranged below the third wire-fixing portion 15. The conductive cable 2 contacts the contact portions 42 of the conductive terminals 4 through the third extension section 233, so that the contact direction (i.e., the Y-axis direction) of the conductive cable 2 and the conductive terminals 4 is perpendicular to the mating direction (i.e., the Z-axis direction) of the wire-clamping connector Z and the mating connector M. That is, a contact surface of the conductive cable 2 and the conductive terminals 4 is parallel to the mating direction of the wire-clamping connector Z and the mating connector M, so as to increase a contact area between the conductive cable 2 and the conductive terminals 4.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A wire-clamping connector assembly, comprising:

a wire-clamping connector, wherein the wire-clamping connector includes:

a casing, wherein the casing includes a first side wall and a second side wall that are opposite to each other, and a first wire-fixing portion, a second wire-fixing portion, and a third wire-fixing portion that are arranged between the first side wall and the second side wall; wherein the third wire-fixing portion is located between the first wire-fixing portion and the second wire-fixing portion, a first gap is formed between the first wire-fixing portion and the third wire-fixing portion, a second gap is formed between the second wire-fixing portion and the third wire-fixing portion, the first wire-fixing portion has a first surface, and the second wire-fixing portion has a second surface; and a conductive cable arranged on the casing along a first direction, wherein the conductive cable includes a first insulating body, a second insulating body, and a conductive cable body; wherein the conductive cable body has a first extension section, a second extension section, and a third extension section, and the third extension section is connected between the first extension section and the second extension section; wherein the first insulating body covers a top surface of the conductive cable body, and the second insulating body covers bottom surfaces of the first extension section and the second extension section of the conductive cable body, such that a bottom surface of the third extension section is exposed; and a mating connector configured to be mated with the wire-clamping connector along a second direction, wherein the second direction is perpendicular to the first direction;

wherein, when the conductive cable is disposed on the casing, the conductive cable passes through the first gap and the second gap, such that the first extension section is arranged on the first surface, a part of the second extension section is arranged on the second surface, and the third extension section is surroundingly arranged below the third wire-fixing portion.

2. The wire-clamping connector assembly according to claim 1, wherein the mating connector includes a main body and a plurality of conductive terminals, the conductive terminals are arranged at fixed intervals and are embedded in the main body, a retaining groove is formed on a surface of the main body that faces toward the wire-clamping connector, each of the conductive terminals has one of a plurality of pins and one of a plurality of contact portions, the pins extend outwardly and are exposed from the main body for being soldered onto a circuit board, and the contact portions are exposed in the retaining groove; wherein, when the mating connector is mated with the wire-clamping connector, the third wire-fixing portion of the casing is inserted into the retaining groove, such that the conductive cable body of the conductive cable is in electrical contact with the contact portions along the first direction.

3. The wire-clamping connector assembly according to claim 2, wherein a limiting groove is formed on a side of the casing that faces toward the main body, the main body further includes an alignment protrusion, and the alignment protrusion is adjacent to the retaining groove; wherein, when the mating connector is mated with the wire-clamping connector, the alignment protrusion is fitted into the limiting groove.

4. The wire-clamping connector assembly according to claim 2, further comprising a first outer frame member disposed on the main body of the mating connector, wherein the first outer frame member has at least one groove hole, and the main body further includes at least one tenon that corresponds to the at least one groove hole; wherein, when the first outer frame member is disposed on the main body of the mating connector, the at least one tenon is fitted into the at least one groove hole.

5. The wire-clamping connector assembly according to claim 4, further comprising a ring-shaped frame member disposed on the casing of the wire-clamping connector, wherein two protruding portions are formed on two sides of the ring-shaped frame member, respectively; wherein two through holes that correspond to the two protruding portions are formed in the first side wall and the second side wall of the casing, respectively; wherein, when the mating connector is mated with the wire-clamping connector, each of the protruding portions is inserted into a corresponding one of the through holes.

6. The wire-clamping connector assembly according to claim 5, wherein, when the mating connector is mated with the wire-clamping connector, the ring-shaped frame member and the first outer frame member structurally interfere with each other.

7. The wire-clamping connector assembly according to claim 6, further comprising a second outer frame member that covers the wire-clamping connector, the mating connector, the first outer frame member, and the ring-shaped frame member, wherein the second outer frame member includes two cantilever members, and two grooves that correspond to the two cantilever members are formed on the first side wall and the second side wall of the casing, respectively; wherein, when the second outer frame member covers the wire-clamping connector and the mating connector that are mated with each other, each of the cantilever members is fitted into a corresponding one of the grooves.

8. The wire-clamping connector assembly according to claim 7, wherein the second outer frame member further includes at least one first hook member and at least one second hook member; wherein, when the second outer frame member covers the wire-clamping connector and the mating connector that are mated with each other, the at least one first hook member is engaged with an end of the first side wall or an end of the second side wall of the casing, and the at least one second hook member is engaged with bottom portions of two sides of the main body.

9. The wire-clamping connector assembly according to claim 1, further comprising at least one adhesive arranged between the second insulating body and the first surface or between the second insulating body and the second surface.

10. The wire-clamping connector assembly according to claim 9, wherein the at least one adhesive is a double-sided adhesive.

* * * * *